United States Patent [19]

Kozdal

[11] 4,077,067

[45] Mar. 7, 1978

[54] TROUSER GARMENTS

[76] Inventor: Emil Kozdal, 11 Rotherwood Rd., Ivanhoe, Victoria, Australia, 3079

[21] Appl. No.: 715,997

[22] Filed: Aug. 19, 1976

[51] Int. Cl.[2] ..... A41D 1/06

[52] U.S. Cl. ..... 2/234; 2/235

[58] Field of Search ..... 2/234, 227, 228, 235, 2/236, 237

[56] References Cited

U.S. PATENT DOCUMENTS

| | | | |
|---|---|---|---|
| 2,336,554 | 12/1943 | Lippmann | 2/234 |
| 3,246,342 | 4/1966 | Pagano | 2/227 X |
| 3,599,242 | 8/1971 | Kozdal | 2/234 |
| 3,751,731 | 8/1973 | Bennett | 2/227 |

*Primary Examiner*—H. Hampton Hunter

*Attorney, Agent, or Firm*—Jenkins, Coffey & Hyland

[57] ABSTRACT

A trouser garment having two leg portions united to form a crotch the leg portions including a pair of front flap portions forming the trouser fly at overlying parts, the flap portions being joined to rear leg portions of the trousers at side seams, linings for the trouser pockets be formed independently of the flap portions and the folded material on the exposed fly fold be secured without exposed stitching.

1 Claim, 4 Drawing Figures

TROUSER GARMENTS

The present invention relates to trouser garments of the type described in my U.S. Pat. No. 3,599,242.

In my earlier patent there was described a trouser garment including two leg portions united to form a crotch, and joining with further leg portions in the normal front and rear longitudinal crease areas to constitute a complete garment, each of said first mentioned leg portions having a transversely extending flap portion including one element of a fastening means such that when the elements of the fastening means are united the flap portions overlie one another to provide a fly means for the garment.

The present invention is an improvement in or modification of the main invention wherein said leg portions are joined at the sides of the trouser legs to form side seams, said transversely extending flap portions are conjoined with the outside seam of the trouser leg, each flap portion being secured only at the fly portion and said side seam. Conveniently the flap portion includes an extra ply of material in the top frontal area of the garment and a pocket can be conveniently formed by sewing a pocket lining on the inside of the extra ply of material between the fly portion and seam. Thus standard pockets are formed independently of the leg portion thus the pockets are unaffected by an tensions on the leg portions. Also the seams at the fly portion are formed free of any exposed stitching.

This results in a major improvement to the appearance of the garment when being worn since the material making up the pockets is virtually independent of any tensions that occur in the garment.

Thus, even in the instance of a fashionable form fitting garment access to the front pockets is still practical without the surrounding area being unduly distended.

In one arrangement the fly folds are joined by heat sensitive adhesive layers overlaying the leg portions which when applied, folded and then heated by ironing or steaming the folds are connected to avoid difficlt hidden stitching.

The invention will now be described having reference to the accompanying drawings in which.

Figure 1:
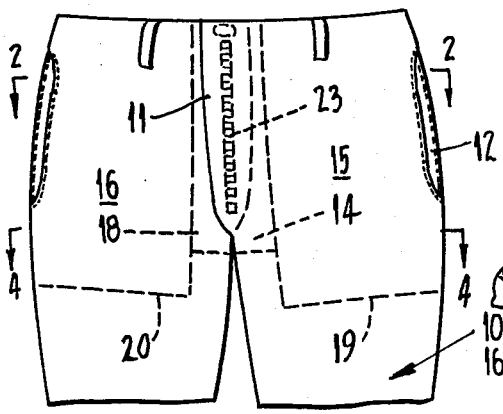
FIG. 1 is a frontal view of the upper part of a pair of trousers.
Figure 3:
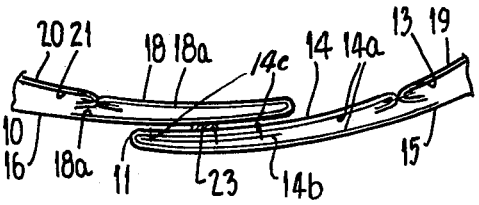
FIG. 3 is a partial plan view of a side flap portion.
Figure 2:
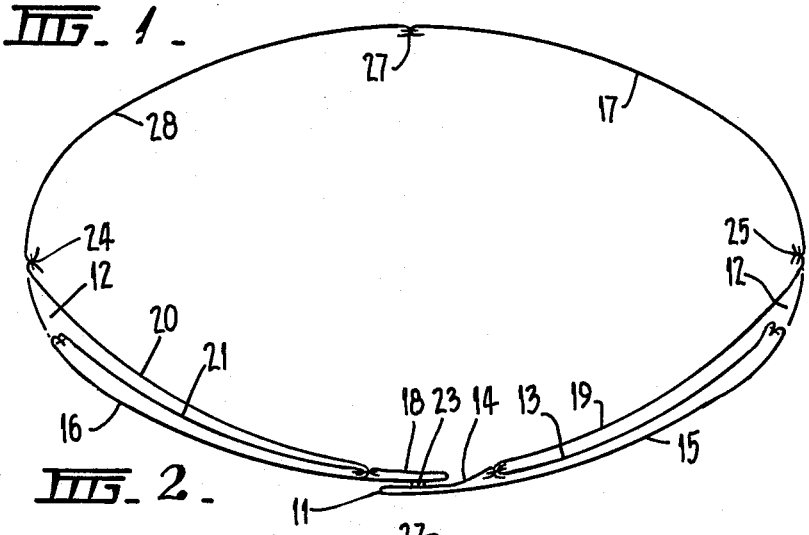
FIG. 2 is a sectional view taken on line 2—2 of FIG. 1.
Figure 4:
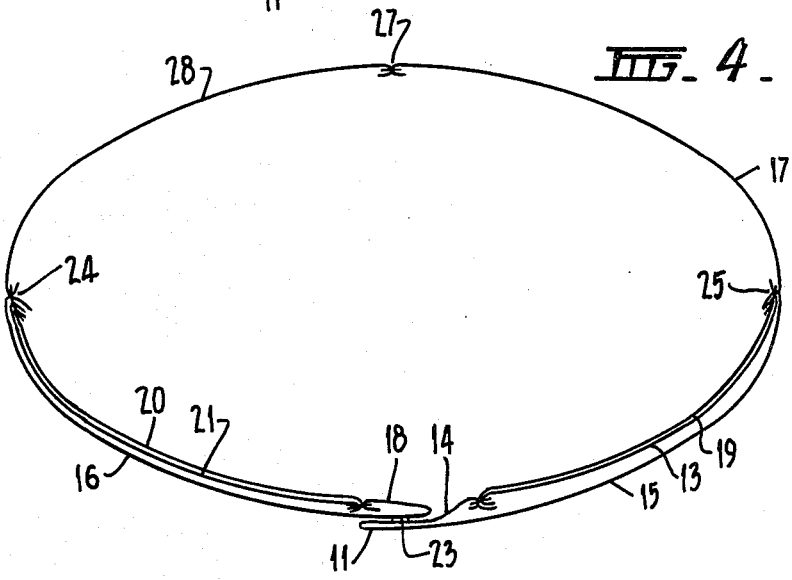
FIG. 4 is a sectional view taken on line 4—4 of FIG. 1.

In one practical arrangement illustrated a pair of trousers is formed from two pairs of cloth portions including front leg portions 15, 16 and rear leg portions 17 and 28 united to form a finished garment.

The rear leg portions 17 and 28 are joined along the crotch line and rear seam 27. The rear leg portions 28 and 17 are joined to the front leg portions 15 and 16 at side seams 24, 25. The front leg portions 15 and 16 are folded at 11 and 18 and overlie to form a fly area.

A zip 23 or buttons of known construction are secured between the folded portions in known manner. Heat sensitive adhesive material **14*a*, 18*a* is adhesively secured to the inside of the fold area at 11 and 18. This lining provides desirable stiffening of the folded material. In addition a further layer of adhesive material 14*b* is stitched to the layer 14*a* by stitching 14*c*** with its adhesive layer facing out.

Thus upon folding of the material at 11 the outer face of material **14*b* contacts the back of adhesive lining 14*a* whereupon hot pressing of the fold, the fold 11** is stiffened and maintained without any external stitching.

Flap portions 19 an 20 extend transversely between the fly folds 11 and 18 and the side seams 24 and 25 from the waist to the crotch. Linings 13 and 21 are secured by stitching to the flap portions 19 and 20 whereby the flap portions 19 and 20 and the linings 13 and 11 form a pair of pockets for the trousers. Thus, the pockets are formed independently of the front leg portions 15 and 16 and the normal exposed stitching conventionally associated with the fly overlay 11 is avoided in the finished garment.

The construction of flap extremities at the front of the garment may incorporate the various alternative features disclosed in my earlier patent.

I claim:

1. A trouser garment comprising a pair of rear leg portions united to form a crotch and rear seam; a pair of front leg portions each joined at one side to one of said rear leg portions to form a pair of side seams, said fron leg portions each including a folded portion opposite the associated side seam, said folded portions being shaped to overlie each other to form a fly, the outermost one of said folded portions including an adhesive material on its internal surfaces for fixing said outermost folded portion when pressure is applied thereto to avoid exposed stitching; means for controllably joining said folded portions together, and a pair of flap portions behind said front leg portions, each of said flap portions extending between and joined to one of said side seams and the folded portion of one of said front leg portions, said flap portions being joined to inner lining pieces between said flap portions and said front leg portions to form pockets independently of said front leg portions whereby stretching of the front leg portions associated with the wearing of the garment tending to cause wrinkles is substantially avoided.

* * * * *

UNITED STATES PATENT OFFICE

CERTIFICATE OF CORRECTION

Patent No. 4,077,067 Dated March 7, 1978

Inventor(s) Emil Kozdal

It is certified that error appears in the above-identified patent and that said Letters Patent are hereby corrected as shown below:

Column 1, line 29, change "an" to --any--.

Column 2, line 20, change "an" to --and--;

line 24, change "11" to --21--;

line 37, Claim 1, change "fron" to --front--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*